US007081605B2

(12) United States Patent
Fritts et al.

(10) Patent No.: US 7,081,605 B2
(45) Date of Patent: Jul. 25, 2006

(54) MICROWAVE INTENSIFICATION SYSTEM FOR A CONVEYORIZED MICROWAVE OVEN

(75) Inventors: Rex E. Fritts, Cedar Rapids, IA (US); Thomas Miller, Wellman, IA (US)

(73) Assignee: Maytag Corporation, Newton, IA (US)

( * ) Notice: Subject to any disclaimer, the term of this patent is extended or adjusted under 35 U.S.C. 154(b) by 5 days.

(21) Appl. No.: 10/849,921

(22) Filed: May 21, 2004

(65) Prior Publication Data

US 2005/0258173 A1 Nov. 24, 2005

(51) Int. Cl.
*H05B 6/78* (2006.01)

(52) U.S. Cl. ..... 219/700; 219/754

(58) Field of Classification Search ..... 219/678–684, 219/690–693, 698, 700–701, 752, 753, 754
See application file for complete search history.

(56) References Cited

U.S. PATENT DOCUMENTS

| | | | | |
|---|---|---|---|---|
| 2,612,596 A | | 9/1952 | Gross | |
| 3,182,166 A | | 5/1965 | Bohm et al. | |
| 3,365,562 A | | 1/1968 | Jeppson | |
| 3,845,266 A | | 10/1974 | Derby | |
| 3,845,270 A | * | 10/1974 | Widugris, Jr. | 219/757 |
| 3,858,022 A | * | 12/1974 | Smith | 219/699 |
| 3,891,818 A | | 6/1975 | Valtersson | |
| 4,529,856 A | * | 7/1985 | Meek et al. | 264/432 |
| 4,990,735 A | | 2/1991 | Lorenson et al. | |
| 5,160,819 A | | 11/1992 | Ball et al. | |
| 5,485,485 A | * | 1/1996 | Briskman et al. | 375/130 |
| 5,958,278 A | * | 9/1999 | Engebritson et al. | 219/741 |
| 6,768,089 B1 | * | 7/2004 | Minobe et al. | 219/699 |
| 6,852,958 B1 | * | 2/2005 | Germain et al. | 219/700 |

* cited by examiner

*Primary Examiner*—Tu Hoang
(74) *Attorney, Agent, or Firm*—Diederiks & Whitelaw, PLC

(57) ABSTRACT

A microwave oven includes an oven cavity arranged within a housing. The oven includes a door and a motorized conveyor belt for transporting food items through the oven cavity. A microwave energy intensification system is provided below the conveyor belt to concentrate and intensify a microwave energy field directed into the oven cavity in order to minimize temperature deviations within the food item.

14 Claims, 1 Drawing Sheet

MICROWAVE INTENSIFICATION SYSTEM FOR A CONVEYORIZED MICROWAVE OVEN

BACKGROUND OF THE INVENTION

1. Field of the Invention

The present invention pertains to the art of cooking appliances and, more particularly, a microwave energy intensification system for producing a uniform cooking environment in a conveyorized microwave oven.

2. Discussion of the Prior Art

In general, commercial or high volume microwave processing of certain types of food items results in lower food quality. This reduction in quality is primarily due to uneven cooking or heating of the food items. Typically, central and peripheral edge portions of the food items are not heated to the same temperature for the same time period. This is particularly true when cooking food items having different densities, such as egg products, meat products and filled pastry products.

For instance, when cooking food items for commercial purposes, it is often desired to establish a target temperature throughout a particular food item. Unfortunately, heating a central portion of the food item to the target temperature results in the outer edges of the food item reaching temperatures well beyond the targeted value. Consequently, the edges of the food item are over-cooked and the central portion of the food item under cooked. Actually, if the edges of the food item are not allowed to "burn" for a sufficient time period, the central portions may not achieve the targeted temperature.

Various methods have been proposed in the prior art to uniformly cook a food item. However, most of the methods proposed inherently involve various tradeoffs which negatively impact cooking efficiency, food costs and processing times. Specifically, it has been proposed to increase the microwave power by adding additional microwave generators to the system. However, increasing the number of generators not only requires additional space, but also creates cost concerns which will be negatively received by the food processing industry. Other proposed methods include processing the food for longer time periods at reduced power levels, reformulating the food items and using a single mode microwave oven design, all of which necessarily increase cook times, or otherwise effect the cost and/or size of the oven which, in the highly competitive field of microwave cooking, is not acceptable.

Based on the above, there exists a need in the art for a microwave intensification system which will provide a uniform cooking environment in a commercial oven. More specifically, the microwave intensification system will cook a food item in a manner that results in a uniformly cooked, final product.

SUMMARY OF THE INVENTION

The present invention is directed to a microwave oven including a housing enclosing an oven cavity having at least one opening into which a food item is delivered. The microwave oven further includes a door and a motorized conveyor belt for transporting the food item through the oven cavity. With this arrangement, as the food item passes through the oven cavity, a microwave energy source is directed upon the food item to perform a cooking operation. In accordance with the invention, the oven includes a microwave energy intensification system that is constituted by a dielectric plate positioned below the conveyor belt. The microwave energy intensification system focuses and intensifies the microwave energy field such that the food item is exposed to a uniform cooking process.

In accordance with the most preferred embodiment, the dielectric plate is maintained in a closely spaced relationship from the food item below the conveyor belt, preferably the dielectric plate is maintained within about ¼ inch (6.35 mm) from the food item. This spaced relationship decreases the wavelength of the microwave energy field so as to produce a greater number of modes and higher energy fields. The increased number of modes and higher energy fields develops higher concentrations of microwave energy, with the result being higher power and more uniform heating.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
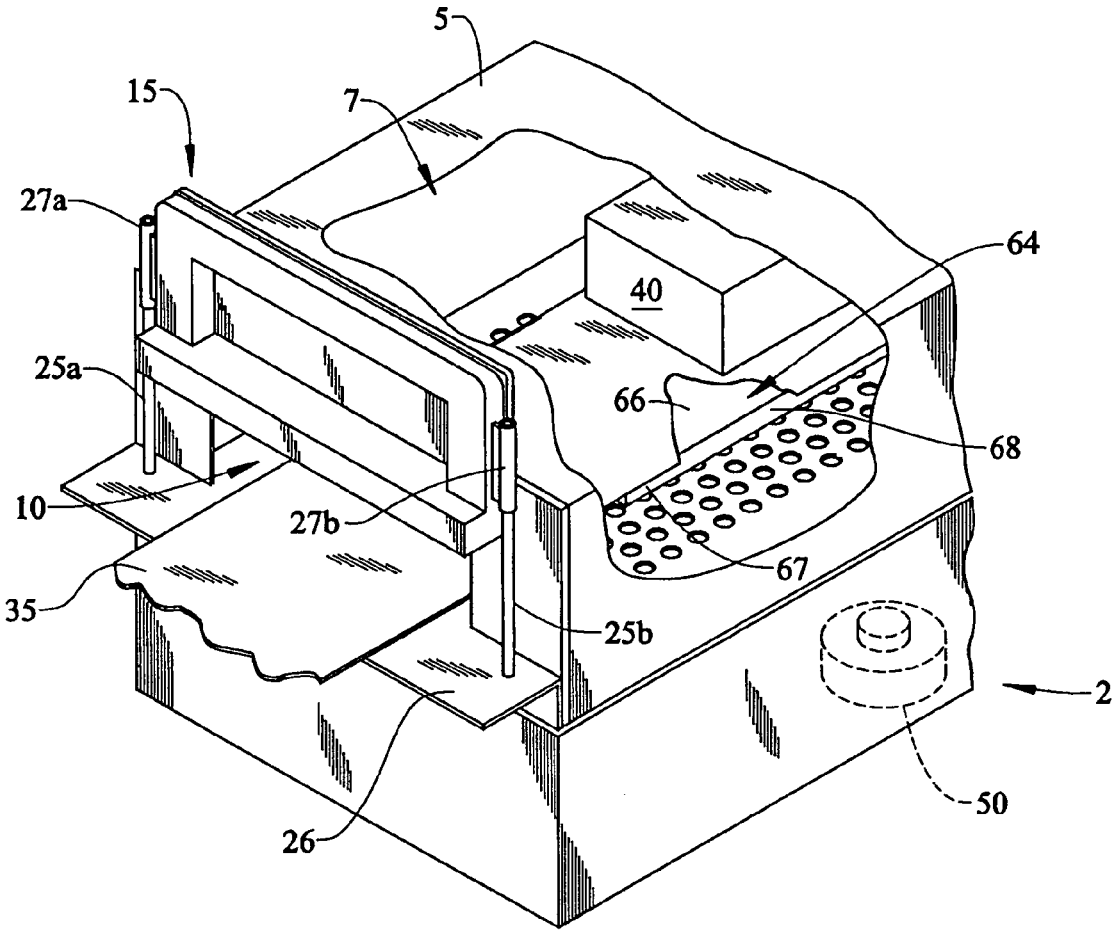
FIG. 1 is an isometric view of a conveyorized microwave oven having a central portion cut-away to depict a microwave intensification system of the invention.
Figure 2:
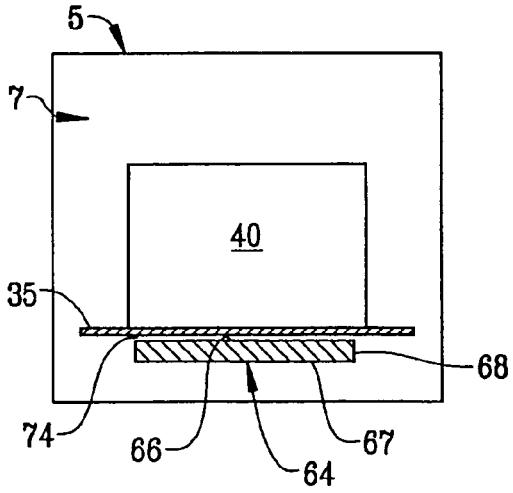
FIG. 2 is a front view of the intensification system of FIG. 1.

With initial reference to FIG. 1, a conveyorized microwave oven constructed in accordance with the present invention is generally indicated at 2. In the most preferred form of the invention, microwave oven 2 has an associated operating frequency of approximately 0.915 or approximately 2.45 GHz. However, the invention could also be employed in a microwave oven operating at other frequencies. As shown, microwave oven 2 includes a housing 5 defining an internal oven cavity 7. Housing 5 includes an opening 10 permitting entry into oven cavity 7. Although not shown, a corresponding opening is provided at an opposing end of housing 5 to establish an exit from oven cavity 7. A door assembly, generally indicated at 15, is provided to selectively close oven cavity 7 at opening 10. In the preferred embodiment shown, door assembly 15 includes a pair of posts 25*a* and 25*b* mounted upon a support plate 26 on either side of opening 10. Door assembly 15 further includes a pair of guides 27*a* and 27*b* which are adapted to slide relative to posts 25*a* and 25*b* respectively, to allow door assembly 15 to be guided vertically between open and closed positions.

Microwave oven 2 further includes a conveyor belt 35 which is adapted to transport a food item 40 through opening 10 into and through oven cavity 7. Conveyor belt 35 traverses the entire length of oven cavity 7 and may extend beyond both opening 10 and the exit of microwave oven 2. When door assembly 15 is opened, conveyor belt 35 moves food item 40 into oven cavity 7. Door assembly 15 is then moved to the closed position and a magnetron 50 is activated to deliver a microwave energy field into oven cavity 7 to initiate a cooking operation. Upon completion of the cooking operation, such as on a timed basis, food item 40 exits oven cavity 10 at an opposite end of housing 5. Therefore, microwave oven 2 is preferably never operated without door assembly 15 covering opening 10 to oven cavity 7. In general, the above-described structure of microwave oven 2 is known in the art and does not constitute part of the present invention. Therefore, this structure has only been described for the sake of completeness and is set forth in greater detail in U.S. Pat. No. 5,958,278 which is hereby incorporated by reference. The present invention is particularly directed to a microwave intensification system mounted within oven cavity 7 below conveyor belt 35 to establish a more uniform cooking environment in oven cavity 7.

In accordance with the invention, the microwave intensification system is constituted by a dielectric plate or slab 64 positioned below conveyor 35. As shown, dielectric plate 64 includes a top surface 66, a bottom surface 67 and a peripheral side section 68 that defines an overall thickness for dielectric plate 64. In accordance with the preferred embodiment of the invention, dielectric plate 64 extends from adjacent opening 10 to adjacent the exit (not shown) of oven cavity 7. In the most preferred form of the invention, dielectric plate 64 is approximately ¼ inch thick (0.635 cm) and made from Coors Alumina ceramic having a dielectric constant of approximately 11.

In further accordance with the most preferred form of the invention, dielectric plate 64 is closely spaced below conveyor belt 35 so as to form a gap 74. Gap 74 is sufficiently small so as to place top surface 66 of dielectric plate 64 within approximately ¼ inch of a bottom surface (not separately shown) of food item 40. Dielectric plate 64 has a lateral dimension which is determined based on the size of food item 40 to be cooked. More particularly, dielectric plate 64 is sized so that edge portions of food item 40 will extend laterally beyond peripheral side section 68.

With this particular arrangement, it has been shown that food item 40 passing through microwave oven 2 is subjected to a more uniform heating process than would otherwise be achieved without the presence of dielectric plate 64. In particular, dielectric plate 64 interacts with the microwave energy field to shorten the microwave energy wave. The shortened energy wave results in a greater number of energy nodes, with higher field concentrations, thereby producing a uniform cooking environment in oven cavity 7. For example, a meat patty passing through microwave oven 2 without a microwave intensification system has been shown to have a body temperature differential ($\Delta T$) of approximately 30° F. (about 16.7° C.) and a maximum edge temperature ($T_{max}$) of approximately 150° F. (65.5° C.). In contrast, the same meat patty passing through microwave oven 2 incorporating the microwave intensification system of the invention has been shown to have a $\Delta T$ body temperature of approximately 14° F. (about 6.6° C.) with a maximum edge temperature $T_{max}$ of approximately 105° F. (about 40.5° C.). Thus, it can be seen that the incorporation of the microwave intensification system significantly alters the overall cooking process and results in a more uniformly cooked food product. Without dielectric plate 64, edge portions of food item 40 will cook prematurely resulting in a poor quality final product. With dielectric plate 64, the entire food item 40 is maintained within a tighter energy range, with edge temperatures reaching levels that do not result in over-cooking.

Although described with reference to a preferred embodiment of the present invention, it should be readily apparent to one of ordinary skill in the art that various changes and/or modifications can be made to the invention without departing from the spirit thereof. For instance, the ranges for gap 74 could vary without departing from the spirit of the present invention. In addition, the overall size and shape of the dielectric plate could be changed depending on the particular design particulars. In general, the invention is only intended to be limited by the scope of the following claims.

We claim:

1. A microwave oven comprising:

a housing;

an oven cavity provided within the housing;

a microwave generator for introducing a microwave energy field into the oven cavity;

a door assembly for selectively sealing the oven cavity;

a motorized conveyor belt passing through the door assembly for transporting a food item through the oven cavity; and a dielectric plate positioned inside the oven cavity and below the conveyor belt, said dielectric plate focusing the microwave energy field onto the food item wherein, as the food item passes through the oven cavity, the food item is exposed to a substantially uniform cooking process.

2. The microwave oven according to claim 1, wherein the dielectric plate is formed of ceramic.

3. The microwave oven according to claim 2, wherein the ceramic is constituted by Coors Alumina ceramic.

4. The microwave oven according to claim 1, wherein the motorized conveyor belt defines a food support surface, said dielectric plate having a width less than a width of the food support surface.

5. The microwave oven according to claim 3, wherein the dielectric plate includes a width, a length and a thickness, said thickness of the dielectric plate being approximately ¼ inch (6.35 mm).

6. The microwave oven according to claim 1, wherein the dielectric plate has a dielectric constant of approximately 11.

7. The microwave oven according to claim 1, wherein the dielectric plate is maintained in a closely spaced relationship from the motorized conveyor belt so as to define a minimal gap between the dielectric plate and a bottom surface of a food item on the conveyor belt.

8. The microwave oven according to claim 7, wherein the gap is approximately ¼ inch (6.35 mm).

9. The microwave oven according to claim 1, wherein the dielectric plate extends substantially an entire length of the oven cavity.

10. A method of uniformly cooking a food item passing through an oven cavity of a microwave oven on a motorized conveyor belt comprising:

directing the food item through a door assembly into the oven cavity over a dielectric plate provided inside the oven cavity and below the conveyor belt; and directing a microwave energy field into the oven cavity, wherein the microwave energy field is intensified by the dielectric plate to minimize temperature deviations across the food item.

11. The method of claim 10, wherein the food item passes over the dielectric plate with outer edge portions of the food item extending laterally outwardly of the dielectric plate.

12. The method of claim 10, wherein the food item is directed over the dielectric plate for substantially an entire length of the oven cavity.

13. The method of claim 10, further comprising: maintaining the dielectric plate in a closely spaced relationship from the motorized conveyor belt so as to define a minimal gap between the dielectric plate and a bottom surface of a food item on the conveyor belt.

14. The method of claim 13, wherein the gap is approximately ¼ inch (6.35 mm).

* * * * *